US005715540A

United States Patent [19]

Cho

[11] Patent Number: 5,715,540

[45] Date of Patent: Feb. 10, 1998

[54] FREE-SIZE CAP

[75] Inventor: Byoung Woo Cho, Seoul, Rep. of Korea

[73] Assignee: Yupoong & Co., Ltd., Seoul, Rep. of Korea

[21] Appl. No.: 202,975

[22] Filed: Feb. 28, 1994

Related U.S. Application Data

[63] Continuation-in-part of Ser. No. 47,500, Apr. 19, 1993, abandoned.

[51] Int. Cl.[6] ..... A42B 1/22

[52] U.S. Cl. ..... 2/195.3; 2/183

[58] Field of Search ..... 2/183, 172, 195.2, 2/195.3, 195.8, 200.1

[56] References Cited

U.S. PATENT DOCUMENTS 4,491,985 1/1985 Dalton ..... 2/172

4,662,007 5/1987 Lipkin ..... 2/172

*Primary Examiner*—Diana Biefeld

*Attorney, Agent, or Firm*—Armstrong, Westerman, Hattori, McLeland & Naughton

[57] ABSTRACT

A free-size cap is capable of fitting wearers having a range of head sizes. The cap includes a multi-gore shell forming a crown portion, and a visor or bill portion connected to the crown portion. Ones of the gores forming the multi-gore shell are composed of a uniaxially stretchable woven material capable of being stretched only along the chordial axis of said multi-gore shell. The free-size cap has the aesthetic appeal of a fixed-size style cap, being capable of custom fitting all wearers within a predetermined range of head sizes, without requiring an adjustable fastener portion or an open portion on the back of the cap. An advantage of this free-size cap is that it is capable of custom fitting all wearers within a predetermined range of head sizes, without the drawback of changes in shape due to differences in head size.

7 Claims, 6 Drawing Sheets

FREE-SIZE CAP

CROSS-REFERENCE TO RELATED APPLICATION

This application is a Continuation-in-Part of U.S. patent application Ser. No. 08/047,500, filed on Apr. 19, 1993, now abandoned.

BACKGROUND OF THE INVENTION

1. Field of the Invention

The present invention relates to an improved construction of a single or fixed-size cap, and particularly to a single or fixed size cap with a multi-size feature, capable of fitting wearers having a range of head sizes. The cap includes a multi-gore shell forming a crown portion, and a visor or bill portion connected to the crown portion.

2. Description of Related Art

In the past, attempts have been made to provide a cap, such as a baseball cap, which can fit wearers in a range of sizes. Such known caps use an adjustable-length strap, usually disposed at the back of the cap, for adjustment by the wearer. An open area is disposed above the portion of the cap having the adjustable-length strap, to permit the adjustment to be made without significant bunching of the cap. An example of such a cap is shown in FIG. 7. Such caps are in widespread use today, and such adjustable size caps are also referred to hereafter as multi-size caps.

Typically, known multi-size caps include a variable-length snap arrangement, which can include a strap with holes for receiving a projecting snap fastener element carried on another portion of the cap, for example the projecting snap fastener element can be carried on another strap. This arrangement is referred to hereunder as a snap back arrangement, referring to the location of the snap in the back of the cap.

Typically, such multi-size caps are created through the use of the above-mentioned variable-length snap arrangement, to accommodate head or hat sizes ranging from 7 inches to 7¾ inches in ⅛ inch increments. This permits the user to adjust the size as required, but not always with an exact fit.

Typically, a variable length snap arrangement having increments of ⅛ inch adjustments are used in such caps, in which case someone with the head size between 7 and 7⅛, for example, is not provided with the exact fit. An improper adjustment in size lacks comfort and with time changes the shape of the cap. Using a mating hook-and-loop fastener for the size adjustment does not solve the above problems associated with the known multi-size caps, however, since use of such hook-and-loop fasteners (e.g., VELCRO fasteners) is not only bothersome, but the fastened elements are often undone inadvertently, and in such cases the cap can fall off the wearer's head. Also, in the case of an improper adjustment, the cap body wrinkles and distorts the cap.

The aforementioned snap back cap, such as shown in FIG. 7, is further disadvantageous in that the open cap back and the snap arrangement itself detracts from the aesthetic value of the cap. Caps which have been made to a single cap size do not have the aforementioned defects, but retailers stocking such single size caps are then required to carry a very substantial stock of caps so as to have a sufficient number of caps in each specific size. For example, to stock 10 caps in each of 10 sizes, for 10 different cap styles, and in 10 different colors, would already require stocking 10,000 caps. Even then, the single cap size is not a custom fit, but is only approximately the wearer's size, and therefore many wearers will not be fit exactly.

An example of a known multi-size cap is shown in U.S. Pat. No. 4,662,007 to Lipkin. In the Lipkin patent, a cap is taught having a weft knitted ear flap located from one end of the visor around the cap body to the opposite end of the visor. This reference does not teach inclusion of a sweatband because it does not cover the forehead portion of the cap. In the cap art, a sweatband is ordinarily used to provide absorption of sweat and to provide comfort to the wearer.

In the Lipkin patent, an ear flap portion is provided which is adapted to be folded inwardly and upwardly in a first distortion, and consists of weft knitted fabric. However, the ear flap is adapted only to be behind the cap brim, and is not adapted to be used inside of the cap brim. In this patent, the ear flap therein cannot be used as a sweat band because a sweat band must be completely disposed about the interior circumference of the hat, inside the hat body. This is, however, not the situation in the Lipkin patent, in which the ear flap, even when inside the hat, does not extend completely circumferentially around the inside of the hat, and therefore cannot serve as a sweat band. Thus, the hat of Lipkin having an ear flap does not in any way teach a sweat band.

Another example of a known multi-size cap is shown in U.S. Pat. No. 5,153,939 to Howe. This reference teaches a hat structure formed of a knit fabric body and having a removable headband. The headband is attached to a body via hook-and-loop fasteners mounted on the headband and the hat body.

The hat of the Howe patent is constructed by using weft yarn in combination with elastic yarn and non-elastic warp yarn. The material is capable of a 20% uniaxially stretchable capability. It also includes an ear flap made of weft knitted fabric located along the crown beginning and ending in the visor portion. The ear flaps are provided for the comfort of the wearer during unseasonable weather.

The ear flaps in the Howe reference are folded up when not in use. The ear flap when folded up is used as a sweatband. The sweatband of the Howe reference may be of material which is non-elastic or non-stretchable, like conventual items presently in the market. Due to the thickness of the ear flaps, the cap body must be able to stretch to accommodate the thickness. However, in instances when a wearer's head exactly fits the cap when the ear flaps are down, and already stretched once it is folded up, the size diminishes due to the thickness of the ear flaps. Thus, it cannot provide a universal fit.

Also, a cap construction is shown in U.S. Pat. No. 2,106,075 to Tabley. This reference specifically teaches a sweat band having a folded structure, having as one of the layers an absorbent, napped structure. It does not, however, teach an unfolded, single structure.

Another cap is shown in U.S. Pat. No. 5,119,514 to Woehl. This reference teaches construction of a cap having a rear gore in the crown of a stretchable material to provide size adjustment or spanned by a tab which may be an elastic band, a mating hook-and-loop fastener, or a snap fastener adjustable to variable lengths. The cap body of the Woehl reference is similar to that of the Lipkin reference discussed hereinabove, however weft knitted fabric is not used for an ear flap or a sweatband. A tab which may be an elastic band, a mating velcro fastener, or a snap fastener provides the feature to fit a variety of head sizes. However, the Woehl reference does not disclose a crown and sweatband having non-knit combined fabrics woven in stretchable yarn. Additionally, the cap size adjustment used in the Woehl reference may require increased manufacturing costs as compared with other known types of caps discussed above.

Multi-size caps having a baseball-cap style are marketed in a variety of ways. These caps are marketed through conventional retail outlets, and there is also a substantial market for such caps as promotional items. It is more economical to provide retailers with a minimal number of sizes to maintain low inventory requirements, to thereby reduce storage space requirements and to maintain a sufficient number of caps in each size to prevent a shortage of particular cap sizes. There are also economies of scale in providing retailers with a minimum number of sizes. For example, fewer manufacturing forms are required.

In addition to typical retail marketing outlets, various business entities provide such caps as promotional items to employees and/or customers, and in these instances, the outer surface of the crown, at a point above the visor, may carry an emblem or other indicia identifying the business entity. Because of the manner in which these products are marketed, it is highly desirable to provide such products with minimal size variation requirements. Additionally, such multi-size caps are desirable especially to customers who do not know their actual head or cap size. In the case of providing the caps as promotional items, it becomes unnecessary for the business entity to determine in advance each individual's cap size.

Single or fixed-size style caps, for example having a baseball cap style, are also marketed through conventional retail outlets. Such a single size cap is shown, for example, in FIG. 6. The construction of this style of cap without a snap arrangement or other adjustment mechanism, and without an open back portion, requires that the cap be sized specifically only for a particular cap or head size. This type of cap is attractive to customers demanding a custom fit cap which specifically fits their head size. In fact, such fixed-size style caps has established the reputation of being the style that professional athletes wear when on the field, and particularly in Major League Baseball. However, the fixed-size style caps are priced higher because of the higher productions costs; by way of example, it may require 60 different patterns for such fixed-size style caps, plus different stitching and steaming molds for each size. The added cost in time, materials, and labor eventually result in a more expensive product for the consumer. Single or fixed-size style caps requires the retailer to stock numerous sizes for the same cap, and in so doing, the retailer keeps a high inventory, and this results in a low turnover per size and less storage space to meet the demands of customers with different head sizes.

SUMMARY OF THE INVENTION

The free-size cap according to the present invention overcomes the aforementioned disadvantages of the known multi-size caps and of the fixed-size style caps.

The free-size cap according to the present invention has an improved construction so as to be capable of fitting wearers having a range of head sizes. The cap includes a multi-gore shell forming a crown portion, and a visor or bill portion connected to the crown portion.

A significant advantage of the free-size cap according to the present invention is that it has the aesthetic appeal of a fixed-size style cap, being capable of custom fitting all wearers within a predetermined range of head sizes, without requiring an adjustable fastener portion or an open portion on the back of the cap.

Another significant advantage of the free-size cap according to the present invention is that it is capable of custom fitting all wearers within a predetermined range of head sizes, without the drawback of changes in shape due to differences in head size.

According to the present invention, gores forming a rear portion of the crown are uniaxially stretchable in the peripheral direction (also referred to hereafter as the chordial direction) of the cap structure. In other words, the uniaxial stretch occurs in the direction of the edge-band of the cap. Such a material is utilized in all of the gores and in the sweatband of the multi-size cap structures of the present invention, and thereby assist in achieving an accommodation of different wearers.

For purposes of achieving substantially universal utilization with a single cap structure, the material forming the gores for the rear crown portion is selected so that it is capable of a 20 percent stretch along one axial direction. Such material is, of course, commercially available. For those instances where more than one size cap structure will be employed to accommodate all wearers, a uniaxial stretch of up to about 10 percent is normally found to be satisfactory.

The sweatband of the free-size cap according to the present invention is manufactured by having combined fabrics woven with stretchable yarn providing the elasticity necessary to exactly fit all head sizes and the ability to absorb sweat. The free-size cap according to the present invention has elasticity of more than 1 inch along the perimeter, thus covering a wide range of sizes. This stretchable feature permits a cap manufacturer to fit all usual head sizes of children and adults.

The free-size cap according to the present invention is preferably formed in two sizes, one size to fit a standard range of head sizes from S to M (small to medium), and another to fit L to XL (large to extra-large).

The visor material used in the free-size cap according to the present invention is non-stretchable or non-elastic. Even considering the requirements of the presence of the visor or bill, along with the gores adjacent the visor being fabricated of non-stretch fabric, together with the constraint on the number of sizes to be stocked so as to accommodate wearers with heads of normal sizes (i.e., the most common or usual sizes), the cap structure of the present invention has been found to accommodate wearers with heads of normal sizes.

As is conventional, baseball caps employ a crown portion to which a visor is secured to the forward edge of the crown and extends outwardly therefrom. It is desirable for the forward portion of the crown, i.e. the portion adjacent the visor, to be somewhat rigid so that the crown portion adjacent the visor stands somewhat erect. This enhances the appearance of the cap. Also, this construction provides a means for the visor portion to be rigid, durable, and extend generally forward of the wearer's forehead.

The structure of the present invention permits a cap to be designed which is attractive in use, comfortable for the wearer, and further provides the advantageous feature of multiple size capability without requiring an open back portion or adjustment of an adjustable strap member or the like.

It is accordingly an object of the present invention to provide an improved single or fixed size cap, such as a baseball style cap, for fitting multiple head sizes, wherein the crown and the sweatband of the cap are fabricated from a uniaxial stretchable fabric.

It is a further object of the present invention to provide a baseball-style cap having a structure which is capable of multi-size use and which can be made both functional and attractive in its use and appearance.

It is also an object of the present invention to provide a free-size cap according to the present invention having a head band which has an unfolded, single structure.

Other and further objectives of the present invention will become apparent to those skilled in the art upon a study of the following detailed description, the appended claims, and the accompanying drawings. The invention will be described in greater detail below with reference to an embodiment which is illustrated in the drawings.

DETAILED DESCRIPTION OF THE PREFERRED EMBODIMENT

Figure 1:
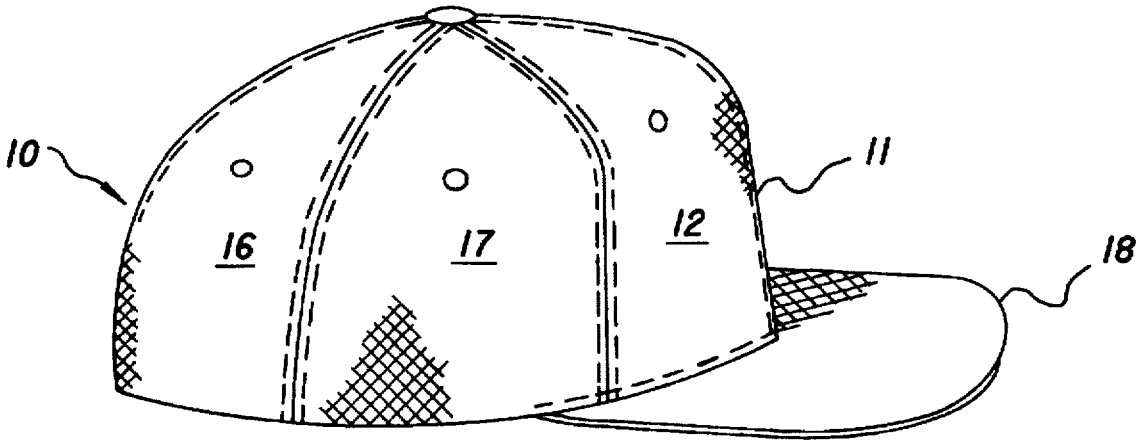
FIG. 1 is a side elevational view of a free-size cap in accordance with the present invention.
Figure 2:
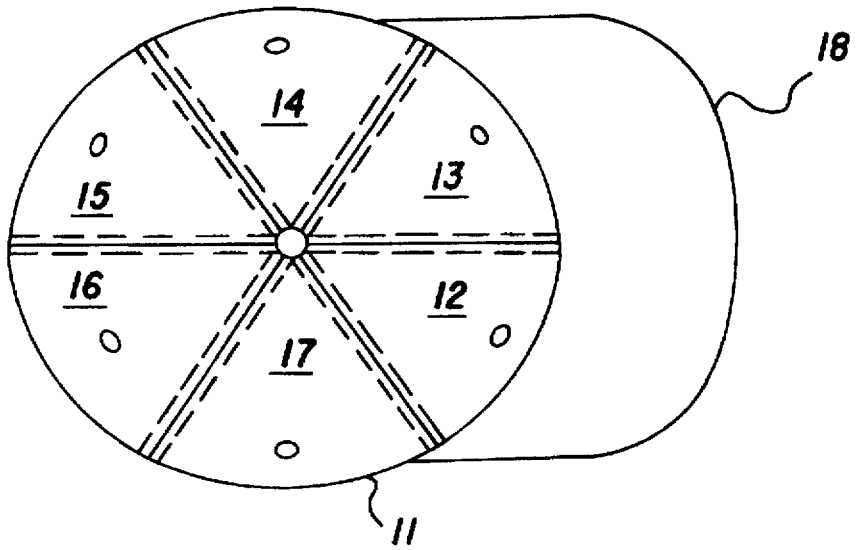
FIG. 2 is a top plan view of the free-size cap shown in FIG. 1.
Figure 3:
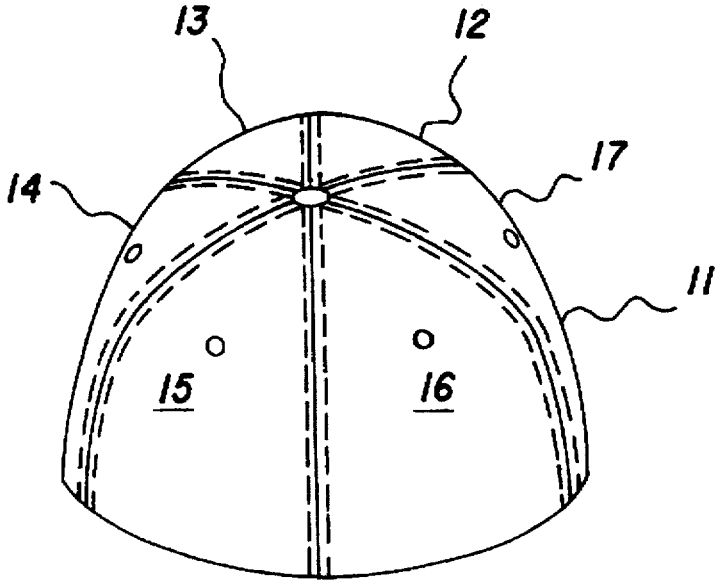
FIG. 3 is a rear elevational view of the free-size cap shown in FIG. 1.

FIGS. 1–3 show side, top, and rear elevational views of a free-size cap 10 in accordance with the present invention, having a crown portion formed by a multi-gore shell 11. The multi-gore shell 11 is formed by a plurality of gores 12, 13, 14, 15, 16, and 17.

As shown in FIG. 2, the multi-gore shell 11 is formed by gores 12, 13, 14, 15, 16, and 17. A visor or bill portion 18 is secured to a forward edge of the multi-gore shell 11 and extends outwardly therefrom. At least gores 14, 15, 16, and 17 are stretchable in a peripheral direction of the free-size cap 10, i.e., in a direction along the lowermost edge of the cap 10. The stretchable gores are composed of a uniaxially stretchable woven fabric, wherein the direction of stretching is arranged to be in the above-mentioned peripheral direction of the free-size cap 10.

The visor portion 18 is in a preferred embodiment somewhat rigid, and hence is not stretchable in the manner in which the gores 14, 15, 16, and 17 of the crown portion are stretchable.

The gores 12 and 13, which are connected to the visor portion 18, are, in the preferred embodiment, formed of stretchable material, however the visor portion 18 prevents it from stretching.

The gores 12 and 13 could also be formed of non-stretchable material, since the visor portion 18 prevents stretching thereof. That is, if the gores 12 and 13 are not formed of stretchable material, they could be formed of either fitted or stiffened materials known in the art. For example, in this situation, in order to provide additional stiffening, the gore members 12 and 13 could be provided with a durable fabric to provide support and shape for the free-size cap 10. The rigidity of the gores 12 and 13 would provide for a crown which stands generally erect, and would thereby also enhance the appearance of the cap, particularly adjacent and above the visor 18. The combination of the generally stiffened gores 12 and 13 with stretchable woven gores 14, 15, 16, and 17, would thereby enhance the ability of the free-size cap 10 to exactly fit all normal head sizes.

Gores 12 and 13 are of stretchable material, however, are unstretchable in the free-size cap according to the present invention because of the stiffened buckram (or bill).

The stretchability feature is present in gores 14, 15, 16, and 17, and as indicated above the gores 14, 15, 16, and 17 stretch only in the peripheral direction of the free-size cap 10. Arrangement of the multi-size structure of the free-size cap 10 is spandex yarn which expands and contracts along the peripheral direction of the free-size cap 10. The gores 14, 15, 16, and 17 include a weft made of stretchable yarn so that there will be adequate expansion and contraction of the lower perimeter of the crown portion 11 of the free-size cap 10.

Figure 4:
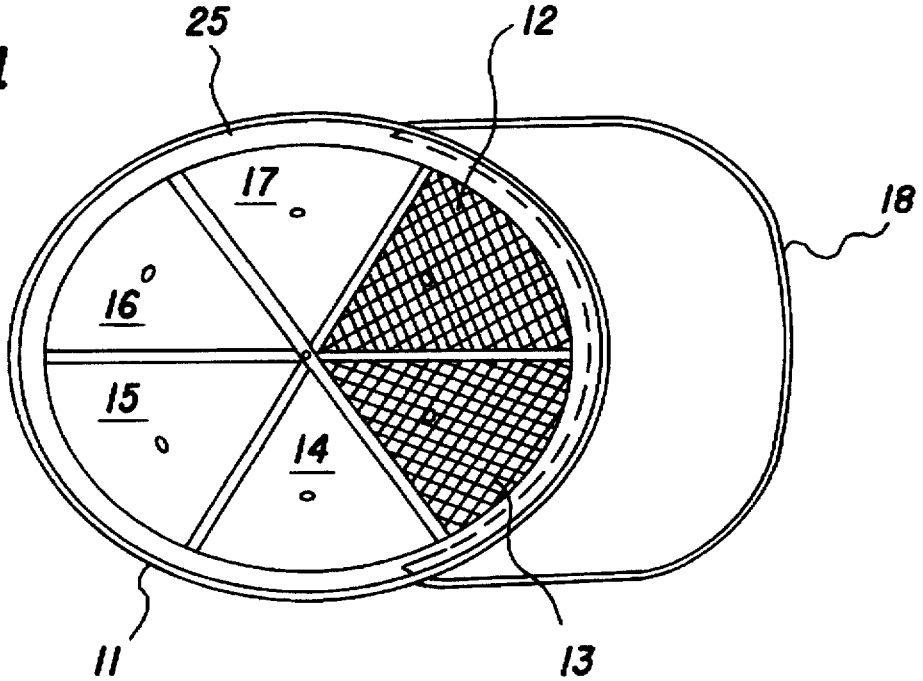
FIG. 4 is a bottom view of the free-size cap shown in FIG. 1, showing the interior of the crown portion of the free-size cap.

FIG. 4, which is a bottom view of the free-size cap 10 shown in FIG. 1, shows a sweatband 25 arranged along the periphery of the interior of the crown portion 11 of the free-size cap 10. The sweatband 25 is also composed of a stretchable fabric, so that is can stretch along with the stretching of the gores 14, 15, 16, and 17.

Figure 5A:
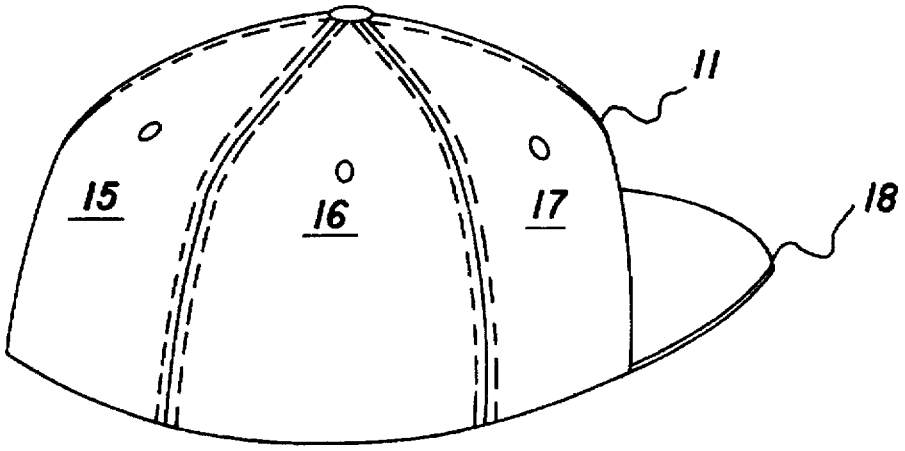
FIG. 5(A) is a perspective view of a rear gore or panel of the free-size cap of FIG. 1, in an unstretched state.
Figure 5B:
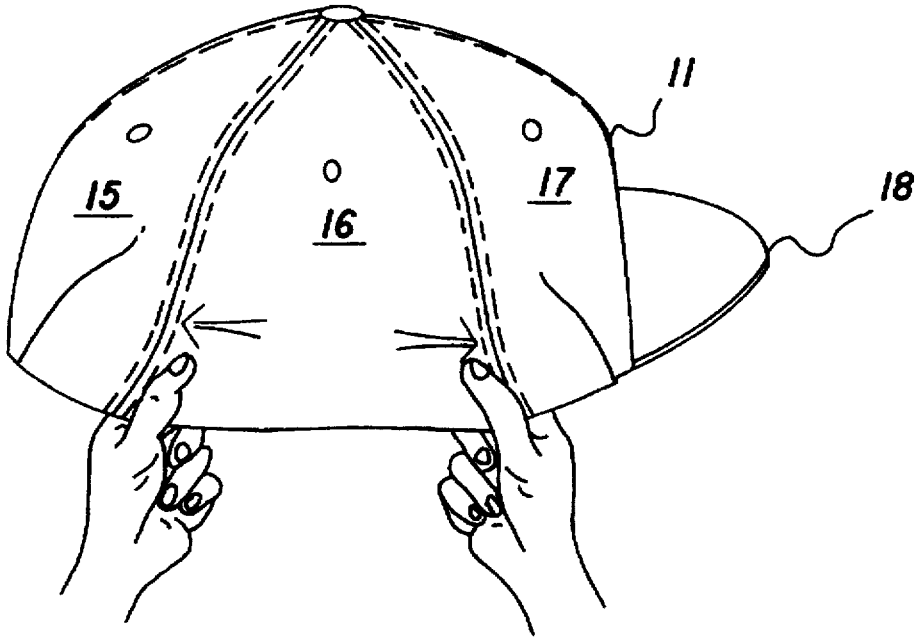
FIG. 5(B) is a perspective view of a rear gore or panel of the free-size cap similar to FIG. 5(A), and showing stretching of the gore or panel in a peripheral direction.
Figure 6:
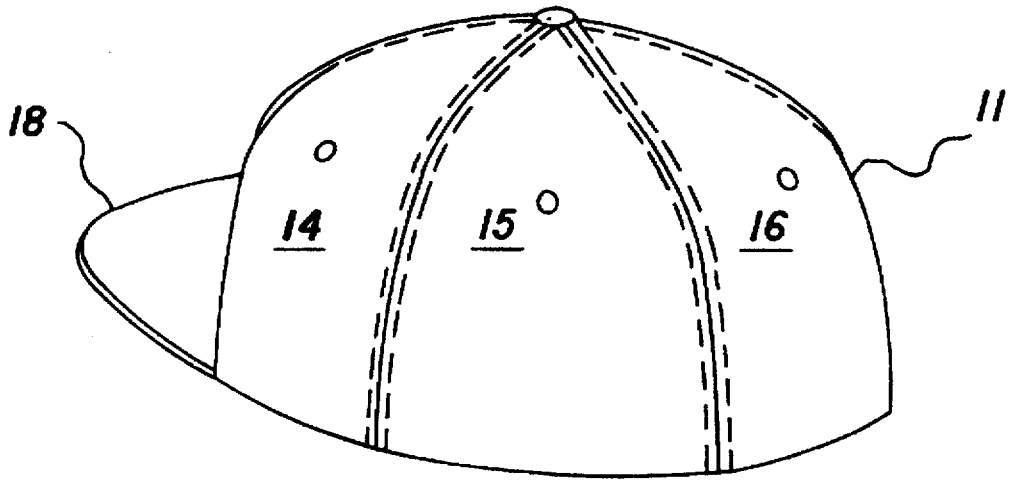
FIG. 6 is a perspective view of a known type of single or fixed size cap.
Figure 7:
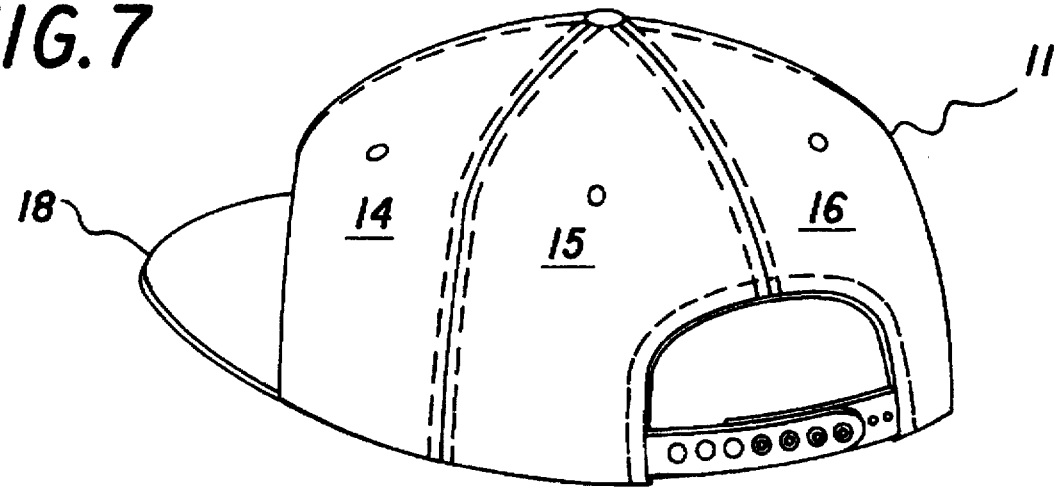
FIG. 7 is a perspective view of a known type of multi-size cap having an open back portion and an adjustment strap.

FIG. 5 (A) shows gores 17, 15, and 16 in the rear portion of the free-size cap 10 in an unstretched state. FIG. 5(B) shows the manner in which the gore 16 stretches when opposite forces are manually applied in opposite directions to the lower peripheral portion thereof.

The fabric pattern of a suitable fabric is as shown below. As shown below, the yarn count has a warp of blended spun yarn, which is 70% polyester and 30% wool, and a weft of blended spun yarn which is also 70% polyester and 30% wool.

I. Fabric pattern

A. Yarn count 1. warp—Blended spun yarn (40's/2) Polyester 70%/Wool 30%
2. weft—Blended spun yarn (40's/2) Polyester 70%/Wool 30%

40D Polyurethane: corn yarn initial blend

75D Polyurethane: covering yarn

* warp is woven with weft in intervals between a and b.

II. Fabric Structure; two-up, two-down

III. Weight:

14 oz./yard warp 40's/2: 0.3 Kg./yd weft 30's/1: 0.068 Kg./yd

Polyester 75D: 0.42 Kg./yd

Spandex 40D: 0.012 Kg./yd

IV. Width: 56 inches

Figure 8:
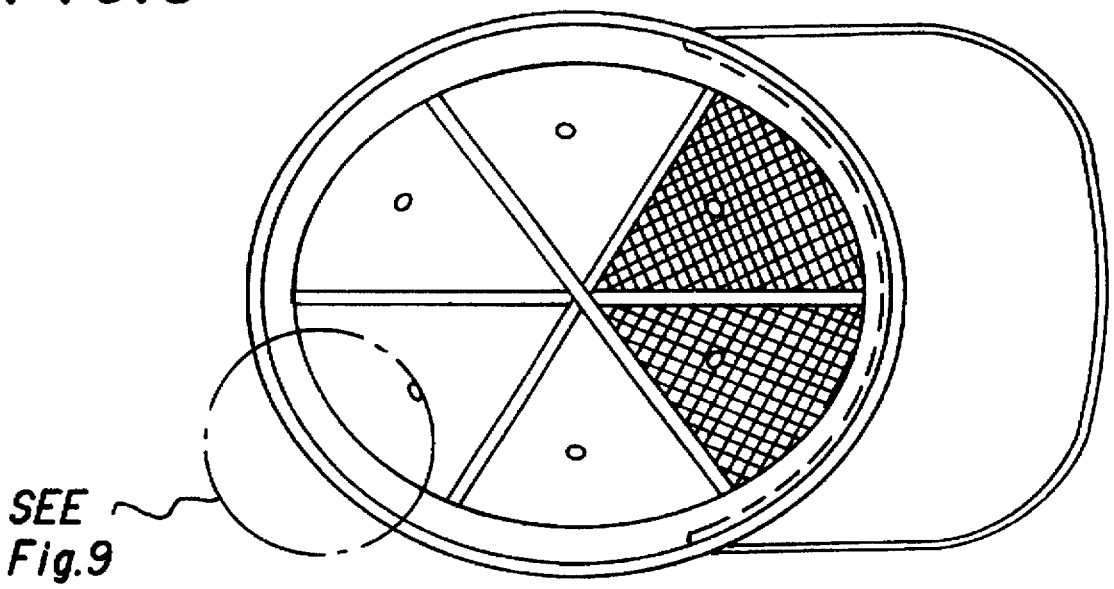
FIG. 8 is a bottom view of the free-size cap similar to that shown in FIG. 4, showing the head band attached in the interior of the crown portion of the free-size cap.

FIG. 8 is similar to FIG. 4, and shows the head band attached in the interior of the crown portion of the free-size cap.

Figure 9:
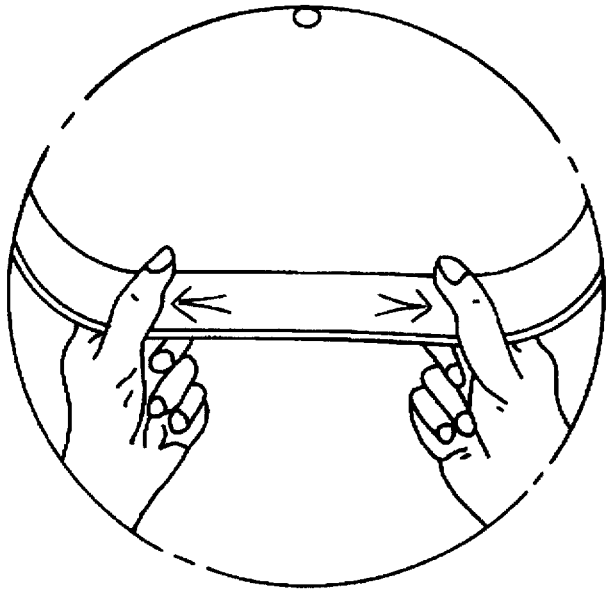
FIG. 9 is an enlarged view of a portion of FIG. 8, illustrating the stretching of the head band of the free-size cap.

FIG. 9 is an enlarged view of a portion of FIG. 8, and illustrates the stretching of the head band of the free-size cap.

Figure 10:
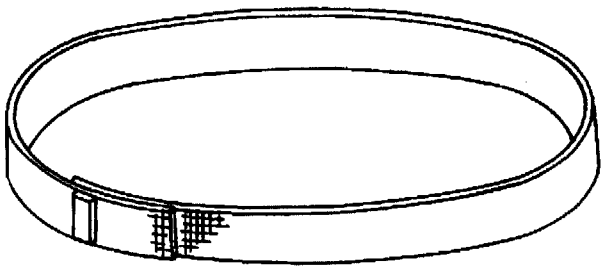
FIG. 10 is a view of the head band according to the present invention.

FIG. 10 is a view of the head band according to the present invention, isolated from the crown portion of the cap. The head band is in the form of a closed loop. When assembled, the head band is contiguously attached to the crown portion of the free-size cap.

Figure 11:
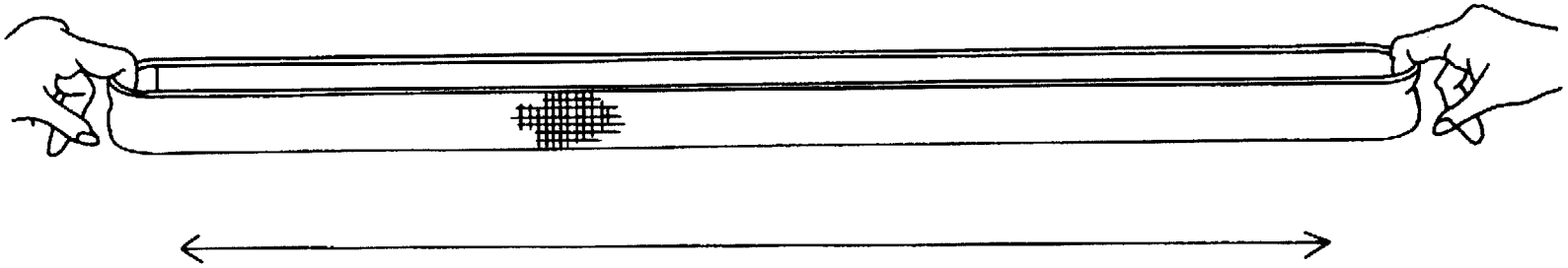
FIG. 11 illustrates the head band shown in FIG. 10, in a stretched condition.

FIG. 11 illustrates the head band shown in FIG. 10, wherein the head band is in a stretched condition.

An example of the free-size cap according to the present invention is described below.

In the method of manufacturing a free-size cap according to this example of the present invention, the cap includes an elastic woven cap body comprising elastic weft yarn and non-woven warp yarn, an elastic sweat band of weft knitted fabric, and a known type of cap brim.

More specifically, in this example of the free-size cap according to the present invention, the cap includes an elastic woven cap body which includes polyurethane elastic yarn (more than 80% by weight of polyurethane) having a maximum 6 inches range of stretchability at the length of 60 cm, and weft knitted fabric having a maximum of 6 inches range of stretchability at the length of 60 cm in the weft direction. The free-size cap according to the present invention also includes a sweat band which includes a knitted fabric having a maximum 6 inches range of stretchability at the length of 60 cm in the weft direction and weft yarn in which the weft yarn is blended with 65% by weight of polyester fibers and 35% by weight of cotton.

It will be understood that the above description of the present invention is susceptible to various modifications, changes and adaptations, and the same are intended to be comprehended within the meaning and range of equivalents of the appended claims.

What is claimed is:

1. A free size cap comprising:

a main body having a plurality of gores forming a crown portion having a lower peripheral edge, wherein at least some of said plurality of gores are composed of uniaxially stretchable fabric aligned to stretch only in a peripheral direction so that said main body has an appearance of being fitted rather than adjustable, said uniaxially stretchable fabric being woven fabric so that said main body is adjustable to fit a range of head sizes; and a sweat band connected to said lower peripheral edge of said crown portion, said sweat band being a single unfolded sheet in structure, and is woven with a uniaxially stretchable fabric so that it is adjustable together with said main body to fit various head sizes.

2. A free-size cap as claimed in claim 1, wherein said sweatband is composed of weft knitted fabric material having a napped surface.

3. A free size cap as claimed in claim 2, wherein said sweatband is sewn to an interior of said crown portion of said main body.

4. A free size cap having an appearance of being fitted while actually being adjustable to fit a range of head sizes, comprising:

a main body having a plurality of gores forming a crown portion having a lower peripheral edge;

a visor portion connected to a peripheral portion of at least one of said plurality of gores, wherein each of said plurality of gores which are not in contact with said visor are composed of a uniaxially stretchable fabric aligned to stretch only in a peripheral direction so that said main body has an appearance of being fitted rather than adjustable, and wherein said uniaxially stretchable fabric is a woven fabric so that said main body is adjustable to fit a range of head sizes; and a sweat band connected to said lower peripheral edge of said crown portion, wherein said sweat band is a single unfolded sheet in structure, and is woven with a uniaxially stretchable fabric so that said sweat band is adjustable together with said main body to fit various head sizes.

5. A free-size cap as claimed in claim 4, wherein said sweatband is composed of weft knitted fabric material having a napped surface.

6. A free size cap as claimed in claim 5, wherein said sweatband is sewn to an interior of said crown portion of said main body.

7. A multi-size cap adapted to accommodate wearers having a range of head sizes and including a multi-gore shell forming a crown portion yet having an appearance of being fitted, a visor portion secured to a forward edge of said shell and extending outwardly therefrom, said multi-gore shell including a pair of front gores fixedly secured to said visor, and a plurality of lateral and rear gores, each of said plurality of gores extending from a common apex point, said front gores being composed of an unstretchable material which is sufficiently rigid to be self-supporting; the improvement comprising:

said lateral and rear gores being composed of a uniaxially stretchable material capable of being stretched only along a chordial axis of said multi-gore shell; wherein said uniaxially stretchable fabric is a woven fabric having spandex yarn woven therein for weft and having yarn having no elasticity for warp, and wherein said weft is disposed in a front and rear direction of said main body; and a sweatband disposed along an interior circumference of said multi-gore shell, said sweatband being composed of a uniaxially stretchable material capable of being stretched only along the chordial axis of said multi-gore shell.

* * * * *